US009398378B2

(12) United States Patent
Miyazato et al.

(10) Patent No.: US 9,398,378 B2
(45) Date of Patent: Jul. 19, 2016

(54) ACOUSTIC GENERATOR, ACOUSTIC GENERATING APPARATUS, AND ELECTRONIC APPARATUS

(71) Applicant: KYOCERA Corporation, Kyoto-shi, Kyoto (JP)

(72) Inventors: Kentarou Miyazato, Kirishima (JP); Shuichi Fukuoka, Kirishima (JP); Noriyuki Kushima, Kirishima (JP); Takeshi Hirayama, Kirishima (JP); Tooru Takahashi, Kagoshima (JP); Masato Murahashi, Aira (JP)

(73) Assignee: Kyocera Corporation, Kyoto-Shi, Kyoto (JP)

( * ) Notice: Subject to any disclaimer, the term of this patent is extended or adjusted under 35 U.S.C. 154(b) by 0 days.

(21) Appl. No.: 14/655,486

(22) PCT Filed: Dec. 21, 2013

(86) PCT No.: PCT/JP2013/084381

§ 371 (c)(1),
(2) Date: Jun. 25, 2015

(87) PCT Pub. No.: WO2014/103970

PCT Pub. Date: Jul. 3, 2014

(65) Prior Publication Data

US 2015/0358738 A1 Dec. 10, 2015

(30) Foreign Application Priority Data

Dec. 26, 2012 (JP) ..... 2012-283051

(51) Int. Cl.
*H04R 25/00* (2006.01)
*H04R 17/00* (2006.01)

(Continued)

(52) U.S. Cl.
CPC ..... *H04R 17/00* (2013.01); *H04R 7/04* (2013.01); *H04R 7/18* (2013.01)

(58) Field of Classification Search
CPC ..... H04R 7/04; H04R 7/18; H04R 17/00
USPC ..... 381/191
See application file for complete search history.

(56) References Cited

U.S. PATENT DOCUMENTS 6,097,830 A * 8/2000 Zelinka ..... H04R 7/04 381/408

(Continued)

FOREIGN PATENT DOCUMENTS

| | | | |
|---|---|---|---|
| JP | 2012-110018 | A | 6/2012 |
| WO | 2010/106736 | A1 | 9/2010 |
| WO | 2010/131540 | A1 | 11/2010 |

OTHER PUBLICATIONS

International Search Report, PCT/JP2013/084381, Feb. 4, 2014, 1 pg.

*Primary Examiner* — Duc Nguyen
*Assistant Examiner* — Sean H Nguyen
(74) *Attorney, Agent, or Firm* — Volpe and Koenig, P.C.

(57) ABSTRACT

An acoustic generator according to an embodiment includes a film-shaped vibrating body, a flame, and an exciter. The frame is configured to fix at least both ends of the vibrating body in a second direction perpendicular to a first direction that is a thickness direction of the vibrating body. The exciter is disposed on the vibrating body, and is configured to vibrate itself to vibrate the vibrating body. The vibrating body has a value of an average coefficient of linear expansion during a temperature change from 90° C. to 40° C. set to be not less than a value of the average coefficient of linear expansion of the vibrating body during a temperature change from 40° C. to 90° C., and set to be not less than a value of an average coefficient of linear expansion of the flame during a temperature change from 90° C. to 40° C.

6 Claims, 3 Drawing Sheets

(51) Int. Cl.
*H04R 7/04* (2006.01)
*H04R 7/18* (2006.01)

(56) References Cited

U.S. PATENT DOCUMENTS 8,897,473 B2 11/2014 Fukuoka et al.
2010/0224437 A1* 9/2010 Booth et al. ..... H04R 7/10 181/166
2012/0119617 A1 5/2012 Takahashi et al.
2013/0043766 A1* 2/2013 Takahashi ..... H04R 17/00 310/326

* cited by examiner

ACOUSTIC GENERATOR, ACOUSTIC GENERATING APPARATUS, AND ELECTRONIC APPARATUS

CROSS-REFERENCE TO RELATED APPLICATIONS

This application is national stage application of International Application No. PCT/JP2013/084381, filed on Dec. 21, 2013, which designates the United States, incorporated herein by reference, and which claims the benefit of priority from Japanese Patent Application No. 2012-283501, filed on Dec. 26, 2012, the entire contents of which are incorporated herein by reference.

FIELD

The embodiments disclosed herein relate to an acoustic generator, an acoustic generating apparatus, and an electronic apparatus.

BACKGROUND

Conventionally, speakers have been known in which a film of a vibrating body is stretched over a frame and that generate sound by vibrating the vibrating body using a piezoelectric element attached to the vibrating body (see Patent Literature 1, for example).

CITATION LIST

Patent Literature

Patent Literature 1: WO 2010/106736 A1

SUMMARY

Solution to Problem

An acoustic generator according to an aspect of embodiments includes a film-shaped vibrating body, a frame, and an exciter. The frame is configured to fix at least both ends of the vibrating body in a second direction perpendicular to a first direction that is a thickness direction of the vibrating body. The exciter is disposed on the vibrating body, and is configured to vibrate itself to vibrate the vibrating body. The vibrating body has a value of an average coefficient of linear expansion during a temperature change from 90° C. to 40° C. set to be not less than a value of the average coefficient of linear expansion of the vibrating body during a temperature change from 40° C. to 90° C., and set to be not less than a value of an average coefficient of linear expansion of the frame during a temperature change from 90° C. to 40° C.

An acoustic generating apparatus according to an aspect of embodiments includes the acoustic generator and an enclosure. The enclosure surrounds at least part of at least one of main surface sides of the vibrating body.

An electronic apparatus according to an aspect of embodiments includes the acoustic generator and an electronic circuit. The electronic circuit is connected to the acoustic generator. The electronic apparatus has a function of generating sound from the acoustic generator.

DESCRIPTION OF EMBODIMENTS

Figure 1:
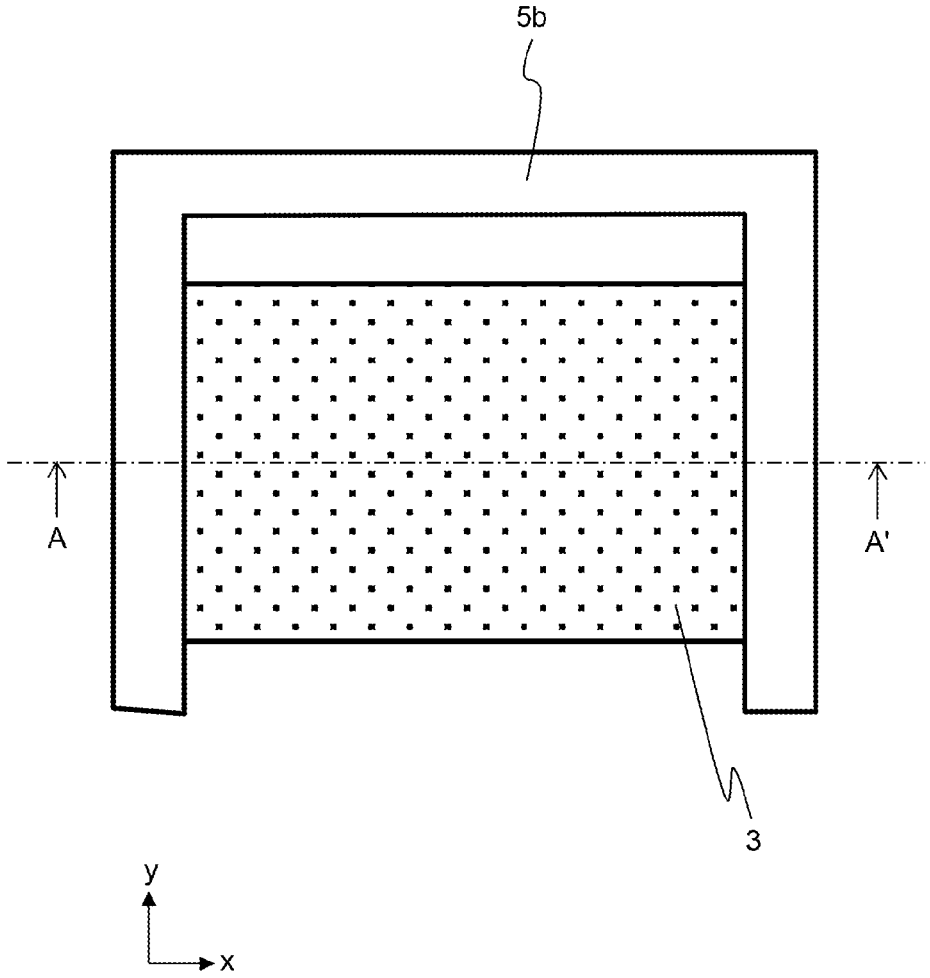
FIG. 1 is a plan view schematically illustrating an acoustic generator according to a first embodiment.

Hereinafter, an acoustic generator, an acoustic generating apparatus, and an electronic apparatus according to embodiments of the present application are described in detail with reference to the accompanying drawings. In the drawings, directions are indicated using x-axis, y-axis, and z-axis that are orthogonal to each other.

First Embodiment

Figure 2:
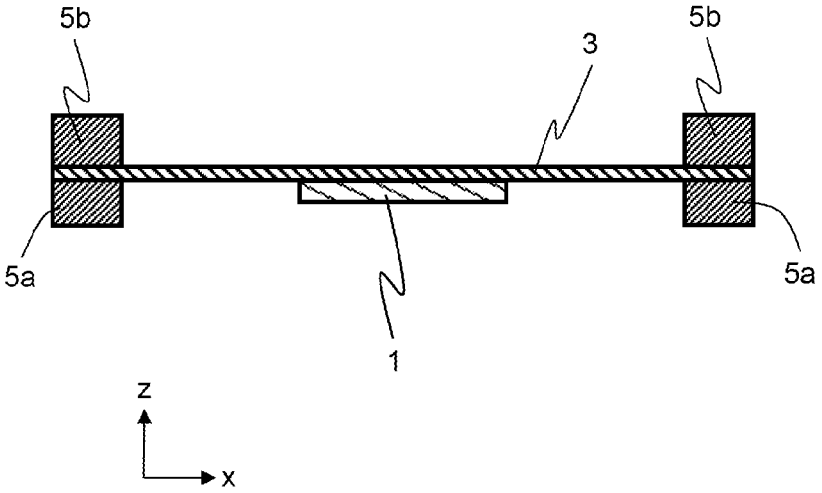
FIG. 2 is a cross sectional view along line A-A' in FIG. 1.

FIG. 1 is a plan view schematically illustrating an acoustic generator according to a first embodiment. FIG. 2 is a cross sectional view along line A-A' in FIG. 1. As illustrated in FIGS. 1 and 2, the acoustic generator in the present embodiment includes an exciter 1, a vibrating body 3, and frames 5*a* and 5*b*.

The vibrating body 3 has a film (membrane) shape and may be formed using various materials. The vibrating body 3 may be formed using, for example, a resin such as polyethylene terephthalate (PET) and polyimide, a metal, paper, or the like. The material for the vibrating body 3 is, however, selected in consideration of need for a coefficient of linear expansion of the vibrating body 3 during a temperature decrease that satisfies a specific relation to be described later between the coefficient of linear expansion of the vibrating body 3 during a temperature decrease and a coefficient of linear expansion of the vibrating body 3 during a temperature increase/a coefficient of linear expansion of the frames 5*a* and 5*b* during a temperature decrease. Additionally, the vibrating body 3 has a thickness of 10 to 200 μm, for example.

The frames 5*a* and 5*b* each have the shape of a "ko" of a Japanese katakana (the shape of the English alphabet "U") and have a thickness of about 0.1 mm to 10 mm, for example. Preferably, the frames 5*a* and 5*b* are harder to deform than the vibrating body 3. Specifically, the frames 5*a* and 5*b* preferably have a greater stiffness and a greater modulus of elasticity than the vibrating body 3. The frames 5*a* and 5*b* may be formed using, for example, a metal such as stainless steel, a resin, ceramics, glass, or the like. It is, however, noted that the coefficient of linear expansion of the vibrating body 3 and the coefficient of linear expansion of the frames 5*a* and 5*b* are required to satisfy the specific relation to be described later with respect to each other, so that the material for the frames 5*a* and 5*b* is selected in accordance with the material for the vibrating body 3.

The vibrating body 3 has both ends in the x-axis direction perpendicular to the z-axis direction that is a thickness direction thereof fixed to the frames 5*a* and 5*b*, so that the vibrating body 3 is vibratably supported by the frames 5*a* and 5*b*. The vibrating body 3 has its both ends in the x-axis direction clamped, and fixed with an adhesive, between the frames 5*a* and 5*b*. The vibrating body 3 is fixed to the frames 5*a* and 5*b* in a condition of being given tension in the x-axis direction. When the frame 5*b* is not included, the vibrating body 3 may be bonded to, for example, a surface of the frame 5*a* at the positive side in the z direction. When the frame 5*a* is not included, the vibrating body 3 may be bonded to, for example, a surface of the frame 5*b* at the negative side in the z direction.

The exciter 1 is a piezoelectric element and is shaped like a plate having rectangular upper and lower main surfaces (both end faces in the z-axis direction). Although not illustrated in detail in the drawings, the exciter 1 includes a laminate body constituted by alternately laminating piezoelectric body layers formed from piezoelectric ceramics and internal electrode layers, surface electrode layers formed on both of the upper and lower surfaces of the laminate body (both end faces in the z-axis direction), and a pair of terminal electrodes provided on the respective end faces of the laminate body in the lengthwise direction (x-axis direction). The surface electrodes and the internal electrode layers are alternately drawn from both end faces of the laminate body in the lengthwise direction (x-axis direction) and are connected to the corresponding terminal electrodes. Electric signals are applied to the pair of terminal electrodes through wiring not illustrated.

The exciter 1 is a bimorph piezoelectric element. In response to input of an electric signal, expansion and contraction are reversed at a given moment between one side and the other side in the thickness direction (z-axis direction). The exciter 1 thus bends and vibrates in the z-axis direction in response to input of an electric signal. The vibration of the exciter 1 itself causes the vibrating body 3 to vibrate. The vibration of the vibrating body 3 then generates sound. The exciter 1 may also be a monomorph vibrating element having a structure in which a piezoelectric element contracting and expanding to vibrate in response to input of an electric signal and a metal plate are bonded together, for example. The main surface of the exciter 1 near the vibrating body 3 is bonded to the vibrating body 3 with a known adhesive such as an epoxy-based resin, a silicone-based resin, or a polyester-based resin, a double-faced tape, or the like, for example.

Conventional piezoelectric ceramics, for example, lead zirconate (PZ), lead zirconium titanate (PZT), or a lead-free piezoelectric body material such as a Bi-layered compound and a tungsten bronze structure compound may be used as the piezoelectric body layers of the exciter 1. The thickness of each of the piezoelectric body layers is desirably about 10 to 100 μm, for example.

Various known metal materials may be used as the internal electrode layers of the exciter 1. For example, although the internal electrode layers may contain a metal component made of silver and palladium and a material component forming the piezoelectric body layers, other materials may also be used to form the internal electrode layers. The surface electrode layers and the terminal electrodes of the exciter 1 may be formed using various known metal materials. For example, although the surface electrode layers and the terminal electrodes may be formed using a material containing a metal component made of silver and a glass component, other materials may also be used to form them.

In the acoustic generator in the present embodiment, a value of an average coefficient of linear expansion of the vibrating body 3 during a temperature change from 90° C. to 40° C. is set to be not less than a value of the average coefficient of linear expansion of the vibrating body 3 during a temperature change from 40° C. to 90° C., and is set to be not less than a value of an average coefficient of linear expansion of the frames 5*a* and 5*b* during a temperature change from 90° C. to 40° C. This arrangement allows the vibrating body 3 to be firmly bonded to the frames 5*a* and 5*b* and an acoustic generator capable of generating sound with favorable sound quality to be obtained.

The following describes effects from the above. A thermosetting adhesive or an ultraviolet-curable adhesive is required to firmly bond the vibrating body 3 to the frames 5*a* and 5*b*. Temperature rises to a point considerably higher than normal temperature when the adhesive is cured regardless of whether it is the thermosetting adhesive or the ultraviolet-curable adhesive. Even when the vibrating body 3 and the frames 5*a* and 5*b* are welded together, the temperature during the welding rises to a level considerably higher than the normal temperature. An examination conducted by the inventors has revealed that slackness or wrinkles in the vibrating body 3 would occur or tension acting on the vibrating body 3 would reduce in the case where the normal temperature is resumed following the bonding of the vibrating body 3 to the frames 5*a* and 5*b*, which prevents sound having favorable sound quality from generating. The inventors thus used various materials for the vibrating body 3 and the frames 5*a* and 5*b* and observed conditions after the bonding. The inventors further studied how each material underwent expansion and contraction at changing temperatures. It has, as a result, been known that it is important that the materials be selected for the vibrating body 3 and the frames 5*a* and 5*b* such that the condition that "the value of the average coefficient of linear expansion of the vibrating body 3 during the temperature change from 90° C. to 40° C. is not less than the value of the average coefficient of linear expansion of the vibrating body 3 during the temperature change from 40° C. to 90° C., and is not less than the value of the average coefficient of linear expansion of the frames 5*a* and 5*b* during the temperature change from 90° C. to 40° C." (hereinafter referred to as a first condition) is satisfied when the temperature of the vibrating body 3 and the frames 5*a* and 5*b* is increased from 40° C. to 90° C. and then decreased from 90° C. to 40° C. It has been then found that selecting the materials for the vibrating body 3 and the frames 5*a* and 5*b* so as to satisfy the first condition can prevent the vibrating body 3 from slacking or wrinkling and the tension acting on the vibrating body 3 from reducing in the case where the normal temperature is resumed following the bonding of the vibrating body 3 to the frames 5*a* and 5*b* and thus can prevent the sound quality from deteriorating thereby. Reasons why these effects can be achieved are inferred that a contraction amount of the vibrating body 3 during the temperature decrease is not less than an expansion amount during the temperature increase and that the contraction amount of the vibrating body 3 during the temperature decrease is not less than a contraction amount of the frames 5*a* and 5*b* during the temperature decrease and that the foregoing makes the slackness in the vibrating body 3 and the reduction in the tension difficult to occur.

It is noted that, in this description, a term "not less than" refers to the "equal to" or "greater than", a term "not more than" refers to the "equal to" or "smaller than". Based on measurement accuracy of the coefficient of linear expansion, the coefficient of linear expansion is determined to "be equal" when a deviation is within ±3%. When $L_0$ is a length at room temperature (23° C.) and the length changes from $L_1$ to $L_2$ with the temperature changed from $T_1$ to $T_2$, the average coefficient of linear expansion α is calculated using the expression (1) given below:

$$\alpha=(L_2-L_1)/L_0/(T_2-T_1) \quad (1)$$

To measure the average coefficient of linear expansion of the vibrating body 3 and the frames 5*a* and 5*b*, the measurement sample may be manufactured by machining the vibrating body 3 and the frames 5*a* and 5*b* or manufactured separately using the same materials as those used for the frames 5*a* and 5*b* and the vibrating body 3.

To satisfy the above-described first condition, the vibrating body 3 is formed using polyimide or PET and the frames 5*a* and 5*b* are formed using stainless steel (SUS301H). Various other combinations of materials are assumed for the vibrating body 3 and the frames 5*a* and 5*b* to satisfy the first condition. Measurements of coefficients of linear expansion of a large number of materials are disclosed and the materials that satisfy the condition can be selected from among the disclosed materials as appropriate.

Preferably, the acoustic generator in the present embodiment satisfies, in addition to the above-described first condition, a condition that "the value of the average coefficient of linear expansion of the vibrating body 3 during the temperature change from 40° C. to 90° C. is not more than the value of the average coefficient of linear expansion of the frames 5*a* and 5*b* during the temperature change from 40° C. to 90° C." (hereinafter referred to as a second condition). Satisfying the second condition can further reduce the slackness in the vibrating body 3 and the reduction in the tension acting on the vibrating body 3. The reason why these effects can be achieved is inferred that the slackness in the vibrating body 3 does not tend to occur in the temperature rising phase, either. It is noted that, to satisfy both the first condition and the second condition, for example, the vibrating body 3 may be formed using, polyimide and the frames 5*a* and 5*b* may be formed using stainless steel (SUS301H). Other combinations may also be used.

Additionally, the acoustic generator in the present embodiment preferably satisfies, in addition to the above-described first condition, a condition that "in a temperature change of every 10° C. from 90° C. to 40° C., the value of the average coefficient of linear expansion of the vibrating body 3 is not less than the value of the average coefficient of linear expansion of the frames 5*a* and 5*b*" (hereinafter referred to as a third condition). Specifically, preferably, the value of the average coefficient of linear expansion of the vibrating body 3 during the temperature change from 90° C. to 80° C. is not less than the value of the average coefficient of linear expansion of the frames 5*a* and 5*b* during the temperature change from 90° C. to 80° C.; the value of the average coefficient of linear expansion of the vibrating body 3 during the temperature change from 80° C. to 70° C. is not less than the value of the average coefficient of linear expansion of the frames 5*a* and 5*b* during the temperature change from 80° C. to 70° C.; the value of the average coefficient of linear expansion of the vibrating body 3 during the temperature change from 70° C. to 60° C. is not less than the value of the average coefficient of linear expansion of the frames 5*a* and 5*b* during the temperature change from 70° C. to 60° C.; the value of the average coefficient of linear expansion of the vibrating body 3 during the temperature change from 60° C. to 50° C. is not less than the value of the average coefficient of linear expansion of the frames 5*a* and 5*b* during the temperature change from 60° C. to 50° C.; and the value of the average coefficient of linear expansion of the vibrating body 3 during the temperature change from 50° C. to 40° C. is not less than the value of the average coefficient of linear expansion of the frames 5*a* and 5*b* during the temperature change from 50° C. to 40° C. Satisfying the third condition can further reduce the slackness in the vibrating body 3 and the reduction in the tension acting on the vibrating body 3. The reason why these effects can be achieved is inferred that the slackness in the vibrating body 3 does not tend to occur in each condition during the temperature rising phase. It is noted that, to satisfy both the first condition and the third condition, the vibrating body 3 may be formed using, for example, PET and the frames 5*a* and 5*b* may be formed using stainless steel (SUS301H). Other combinations that satisfy the conditions may also be used.

In the acoustic generator in the present embodiment, the coefficients of linear expansion of the vibrating body 3 and the frames 5*a* and 5*b* are established as described above and the vibrating body 3 is fixed to the frames 5*a* and 5*b* in a condition of being given tension in the x-axis direction. These arrangements allow the tension given to the vibrating body 3 to vary by greatly changing the temperature of an acoustic generator to provide the acoustic generator capable of changing the sound quality of the generated sound by changing the temperature. Additionally, the arrangements can further reduce the occurrence of the slackness in the vibrating body 3.

The acoustic generator of the present embodiment can be manufactured, for example, in the following manner. First of all, a binder, a dispersant, a plasticizer, and a solvent are added to powder of a piezoelectric material, and the resultant mixture is stirred to produce slurry. As the piezoelectric material, any of lead-based and lead-free materials can be used. Subsequently, a green sheet is produced by shaping the slurry into a sheet form. A conductive paste is then printed on the green sheet to form a conductor pattern serving as an internal electrode. Such green sheets on which the conductor pattern is formed are laminated on one another to produce a laminate molded body.

Then, the laminate molded body is degreased, sintered, and cut to have given dimensions so as to provide a laminate body. The outer peripheral portion of the laminate body is processed if necessary. Subsequently, a conductive paste is printed on the main surfaces of the laminate body in the laminate direction to form conductor patterns serving as surface electrode layers. A conductive paste is printed on both side faces of the laminate body in the lengthwise direction (x-axis direction) to form conductor patterns serving as a pair of terminal electrodes. The electrodes are then baked at a given temperature. In this manner, the structure serving as the exciter 1 can be obtained. Thereafter, in order to give piezoelectric properties to the exciter 1, a direct-current voltage is applied thereto through the surface electrode layers or the pair of the terminal electrodes to polarize the piezoelectric body layers of the exciter 1. The exciter 1 can be thus prepared.

Then, both ends of the vibrating body 3 in a condition of being given tension are clamped and fixed between the frames 5*a* and 5*b* to which an adhesive has been applied and are bonded with the frames with the adhesives being cured. The exciter 1 is bonded to the vibrating body 3 using an adhesive. In such a manner, the acoustic generator of the present embodiment can be produced.

Second Embodiment

Figure 3:
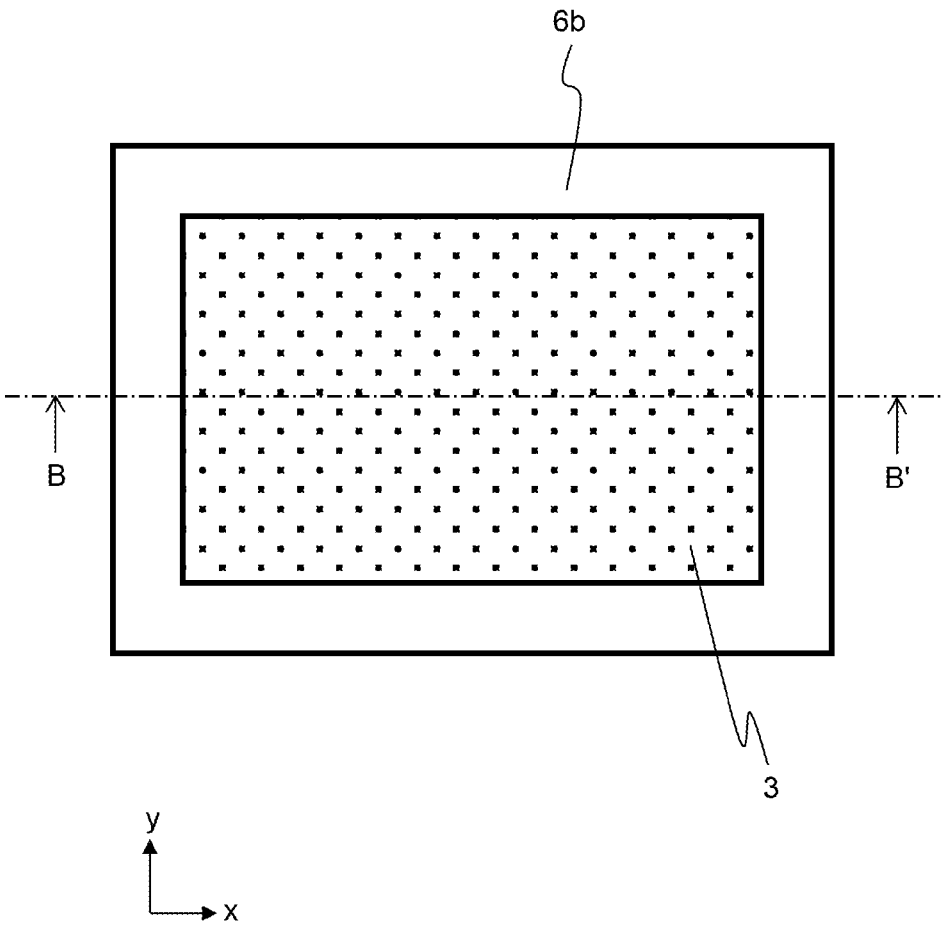
FIG. 3 is a plan view schematically illustrating an acoustic generator according to a second embodiment.
Figure 4:
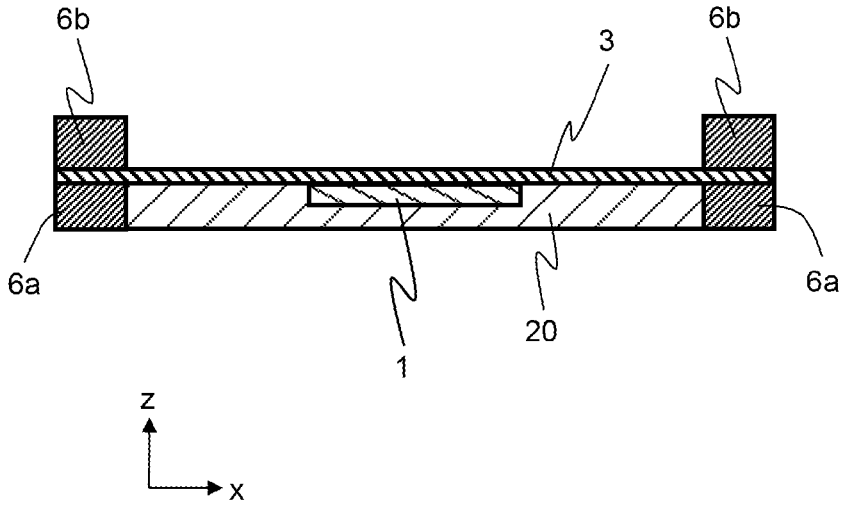
FIG. 4 is a cross sectional view along line B-B' in FIG. 3.

FIG. 3 is a plan view schematically illustrating an acoustic generator according to a second embodiment. FIG. 4 is a cross sectional view along line B-B' in FIG. 3. In the present embodiment, only differences from the acoustic generator in the above-described first embodiment are described and the same reference signs denote the same constituent components and overlapped description thereof is omitted.

As illustrated in FIGS. 3 and 4, the acoustic generator in the present embodiment includes frames 6*a* and 6*b* in place of the frames 5*a* and 5*b*. The acoustic generator in the present embodiment further includes a resin layer 20.

The frames 6*a* and 6*b* each have a rectangular frame shape. A vibrating body 3 has a peripheral edge portion of its rectangular shape, the entire peripheral edge portion being clamped and fixed generally between the frames 6*a* and 6*b* in a condition of being given tension in a planar direction (the x-axis direction and the y-axis direction). The vibrating body 3 is vibratably supported by the frames 6*a* and 6*b*. The material for the frames 6*a* and 6*b* is selected in a manner similar to that used when the material for the frames 5*a* and 5*b* in the acoustic generator in the above-described first embodiment is selected. The shape of the frames 6*a* and 6*b* is not limited to the rectangle and may be a circle or a rhombus.

The resin layer 20 fills all over the inner side of the frame 6*a* such that an exciter 1 is buried therein. The resin layer 20 can be formed using various known materials. For example, resins such as acrylic-based resins and silicone-based resins, rubber, or the like can be used. For example, Young's modulus is desirably in a range of 1 MPa to 1 GPa. The thickness of the resin layer 20 is desirably the thickness with which the exciter 1 is completely covered in terms of spurious reduction, but is not limited thereto. A given advantageous effect can be achieved when at least part of the vibrating body 3 is covered.

The acoustic generator in the present embodiment having the arrangements as described above can also achieve the similar effects as those achieved by the acoustic generator in the above-described first embodiment when the vibrating body 3 and the frames 6*a* and 6*b* are selected so as to satisfy conditions similar to the above-described first through third conditions.

Specifically, by selecting the materials for the vibrating body 3 and the frames 6*a* and 6*b* so as to satisfy a condition that "the value of the average coefficient of linear expansion of the vibrating body 3 during the temperature change from 90° C. to 40° C. is not less than the value of the average coefficient of linear expansion of the vibrating body 3 during the temperature change from 40° C. to 90° C., and is not less than the value of the average coefficient of linear expansion of the frames 6*a* and 6*b* during the temperature change from 90° C. to 40° C." (hereinafter referred to as a fourth condition), the acoustic generator in the present embodiment can prevent the slackness in the vibrating body 3 and the reduction in the tension acting on the vibrating body 3 and can prevent aggravation of the sound quality thereby.

Additionally, by selecting the materials for the vibrating body 3 and the frames 6*a* and 6*b* so as to satisfy, in addition to the fourth condition, a condition that "the value of the average coefficient of linear expansion of the vibrating body 3 during the temperature change from 40° C. to 90° C. is not more than the value of the average coefficient of linear expansion of the frames 6*a* and 6*b* during the temperature change from 40° C. to 90° C." (hereinafter referred to as a fifth condition), the acoustic generator in the present embodiment can further reduce the slackness in the vibrating body 3 and the reduction in the tension acting on the vibrating body 3.

Additionally, by selecting the materials for the vibrating body 3 and the frames 6*a* and 6*b* so as to satisfy, in addition to the fourth condition, a condition that "in a temperature change of every 10° C. from 90° C. to 40° C., the value of the average coefficient of linear expansion of the vibrating body 3 is not less than the value of the average coefficient of linear expansion of the frames 6*a* and 6*b*" (hereinafter referred to as a sixth condition), the acoustic generator in the present embodiment can further reduce the slackness in the vibrating body 3 and the reduction in the tension acting on the vibrating body 3.

In the acoustic generator in the present embodiment, the vibrating body 3 has both ends in the y-axis direction fixed to the frames 6*a* and 6*b*, in addition to having both ends in the x-axis direction fixed thereto. This arrangement allows the number of resonances in vibrations of the vibrating body 3 to be increased, so that the resonance frequency is dispersed in the use frequency band. This allows sound pressure of the sound generated by the acoustic generator to have flat and favorable frequency characteristics.

In the acoustic generator in the present embodiment, tension is given in both the x-axis direction and the y-axis direction. Thus, selecting the vibrating body 3 and the frames 6*a* and 6*b* so as to satisfy at least the fourth condition allows the tension in both the x-axis direction and the y-axis direction given to the vibrating body 3 to be changed by greatly changing the temperature of the acoustic generator. An acoustic generator capable of further changing the sound quality of the generated sound through the change in the temperature can thus be obtained.

In the acoustic generator in the present embodiment, the tension in the x-axis direction may be made different from that in the y-axis direction. Specifically, having the tension in the x-axis direction made different from that in the y-axis direction to thereby change a ratio of the tension in the x-axis direction to that in the y-axis direction allows a condition in which the resonance frequency is distributed among different resonance modes in the vibration of the vibrating body 3 to vary. Thus, the resonance frequency can be more uniformly dispersed in the use frequency band. The sound pressure of the sound generated by the acoustic generator thus can have flatter and more favorable frequency characteristics.

Additionally, having the tension in the x-axis direction made different from that in the y-axis direction and selecting the vibrating body 3 and the frames 6*a* and 6*b* so as to satisfy at least the fourth condition enable the acoustic generator in the present embodiment to be capable of variously setting the change in sound quality to the change in temperature.

Third Embodiment

Figure 5:
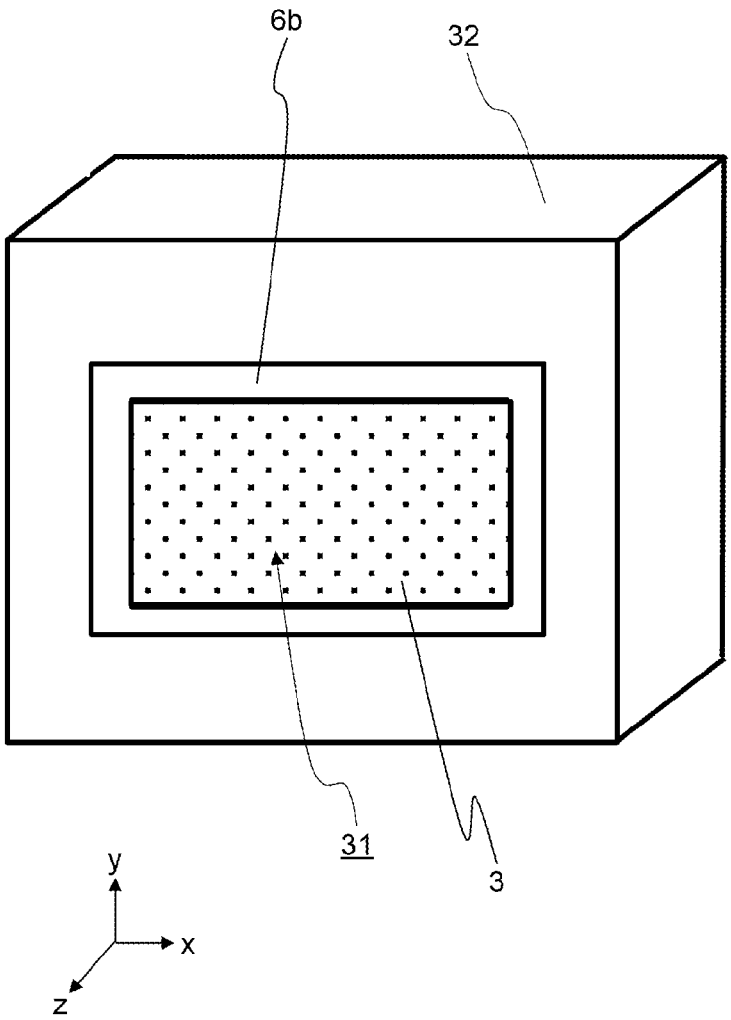
FIG. 5 is a perspective view schematically illustrating an acoustic generating apparatus according to a third embodiment.

FIG. 5 is a perspective view schematically illustrating an acoustic generating apparatus according to a third embodiment. The acoustic generating apparatus in the present embodiment includes, as illustrated in FIG. 5, an acoustic generator 31 and an enclosure 32.

The acoustic generator 31 generates sound (including sound out of an audible frequency band) in response to an input of a sound signal. The acoustic generator 31, although not elaborately illustrated, represents the acoustic generator in the above-described second embodiment.

The enclosure 32 is shaped into a box-like rectangular parallelepiped. The enclosure 32 has at least one opening. The acoustic generator 31 is attached so as to close the opening. The enclosure 32 is formed so as to surround a main surface of the vibrating body 3 on the side on which the exciter 1 is disposed. It is noted that the enclosure 32 is formed so as to surround at least part of at least one main surface of the vibrating body 3. Thus, the shape of the enclosure 32 is not limited to the rectangular parallelepiped. The enclosure 32 may be shaped into, for example, a cone, a sphere, or the like. Additionally, the enclosure 32 does not need to have a box shape. The enclosure 32 may be shaped into a flat plate or the like. The enclosure 32 may have a function of reducing sound in reverse phase generated from a back surface of the acoustic generator 31 and sneaking thereinto or a function of internally reflecting sound generated by the acoustic generator 31. The enclosure 32 can be formed using various known materials. For example, the enclosure 32 may be formed using such materials as wood, synthetic resins, and metals.

The acoustic generating apparatus in the present embodiment generates sound using the acoustic generator 31 configured with the acoustic generator in the above-described second embodiment, and thus can generate sound having favorable sound quality. The acoustic generating apparatus in the present embodiment, including the enclosure 32, can also generate sound having more favorable sound quality than by the acoustic generator 31. It is noted that the acoustic generator in the first embodiment, instead of the acoustic generator in the second embodiment, may be incorporated to achieve the similar effects. Alternatively, a similar acoustic generator according to another embodiment may still be incorporated.

Fourth Embodiment

Figure 6:
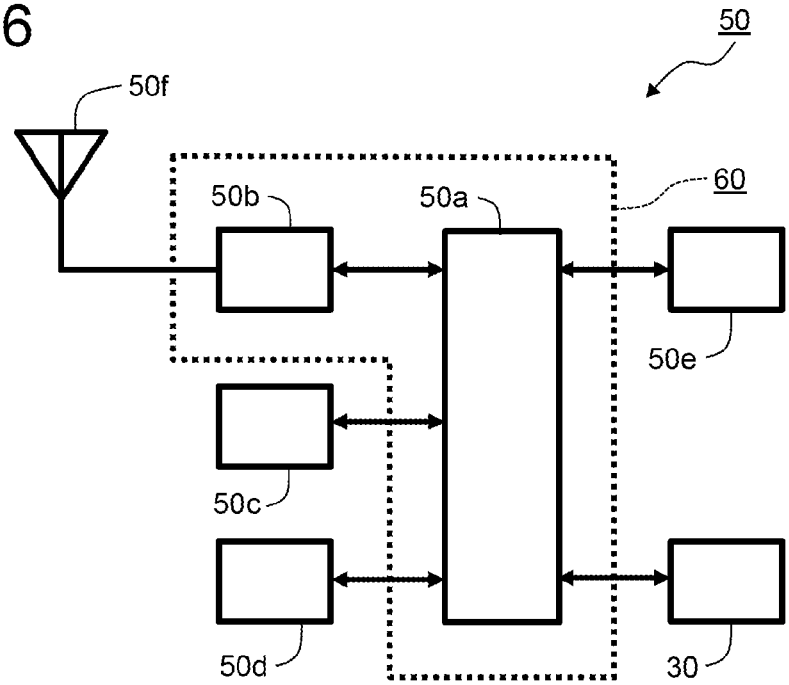
FIG. 6 is a block diagram illustrating a configuration of an electronic apparatus according to a fourth embodiment.

FIG. 6 is a block diagram illustrating a configuration of an electronic apparatus 50 according to a fourth embodiment. As illustrated in FIG. 6, the electronic apparatus 50 of the present embodiment includes an acoustic generator 30, an electronic circuit 60, a key input unit 50*c*, a microphone input unit 50*d*, a display unit 50*e*, and an antenna 50*f*. FIG. 6 is a block diagram of an electronic apparatus that is assumed to be, for example, a mobile phone, a tablet terminal, or a personal computer.

The electronic circuit 60 includes a control circuit 50*a* and a communication circuit 50*b*. The electronic circuit 60 is connected to the acoustic generator 30 and has a function to output a sound signal to the acoustic generator 30. The control circuit 50*a* is a control unit of the electronic apparatus 50. The communication circuit 50*b*, for example, transmits and receives data through the antenna 50*f* on the basis of the control by the control circuit 50*a*.

The key input unit 50*c* is an input device of the electronic apparatus 50 and accepts a key input operation performed by an operator. The microphone input unit 50*d* is also an input device of the electronic apparatus 50 and accepts a sound input operation performed by an operator. The display unit 50*e* is a display output device of the electronic apparatus 50 and outputs display information on the basis of the control by the control circuit 50*a*.

The acoustic generator 30 is an acoustic generator as described in the first or the second embodiments. The acoustic generator 30 functions as an acoustic output device in the electronic apparatus 50. The acoustic generator 30 generates sound (including sound out of an audible frequency band) in response to a sound signal input from the electronic circuit 60. The acoustic generator 30 is connected to the control circuit 50*a* of the electronic circuit 60 and generates sound when a voltage controlled by the control circuit 50*a* is applied thereto.

As described above, the electronic apparatus 50 in the present embodiment includes at least the acoustic generator 30 and the electronic circuit 60 connected to the acoustic generator 30 and has a function of generating sound from the acoustic generator 30. The electronic apparatus 50 in the present embodiment as described above, because the electronic apparatus 50 generates sound using the acoustic generator 30 according to the above-described first or second embodiment, can generate sound having favorable sound quality.

As an example of the configuration of the electronic apparatus 50, the housing of the electronic apparatus 50 may include therein the electronic circuit 60, the key input unit 50*c*, the microphone input unit 50*d*, the display unit 50*e*, the antenna 50*f*, and the acoustic generator 30, which are illustrated in FIG. 6. As another example of the configuration of the electronic apparatus 50, an apparatus main body including the electronic circuit 60, the key input unit 50*c*, the microphone input unit 50*d*, the display unit 50*e*, and the antenna 50*f*, which are illustrated in FIG. 6, in the housing is connected to the acoustic generator 30 in such a manner that they can transmit electric signals through a lead wire or the like.

The electronic apparatus of the present embodiment does not need to include all of the key input unit 50*c*, the microphone input unit 50*d*, the display unit 50*e*, and the antenna 50*f*, which are illustrated in FIG. 6, and may include at least the acoustic generator 30 and the electronic circuit 60. The electronic apparatus 50 may also include other constituent components. Furthermore, the electronic circuit 60 is also not limited to the configuration of the electronic circuit 60 described above and may be an electronic circuit having another configuration.

The electronic apparatus of the present embodiment is not limited to the above-mentioned electronic apparatus such as a mobile phone, a tablet terminal, or a personal computer. In various types of electronic apparatuses having a function to generate sound or voice, such as a television, audio equipment, a radio, a vacuum cleaner, a washing machine, a refrigerator, and a microwave oven, the acoustic generator 30 as described in the first or the second embodiments can be used as an acoustic generating apparatus.

Modification

The present disclosure is not limited to the above-mentioned embodiments, and various changes or improvements can be made in a range without departing from a concept of the invention.

For example, although an example in which a single exciter 1 is attached to the surface of the vibrating body 3 is described in the above-described embodiments so as to simplify the drawings, the embodiments are not limited thereto. For example, a larger number of exciters 1 may also be attached onto the surface of the vibrating body 3. Alternatively, for example, the exciter 1 and/or the resin layer 20 may be provided at both surfaces of the vibrating body 3.

Although an example in which a piezoelectric element is used as the exciter 1 is described in the above-described embodiments, the embodiments are not limited thereto. The exciter 1 only has to have a function to change electric signals into mechanical vibration, and other devices having a function to change electric signals into mechanical vibration may also be used as the exciter 1. For example, an electrodynamic exciter, an electrostatic exciter, and an electromagnetic exciter that have been known as exciters vibrating a speaker may be used as the exciter 1. The electrodynamic exciter applies an electric current to a coil arranged between magnetic poles of a permanent magnet to vibrate the coil. The electrostatic exciter applies a bias and an electric signal to two opposing metal plates to vibrate the metal plates. The electromagnetic exciter applies an electric signal to a coil to vibrate a thin iron plate.

Example

The following describes an example of the present disclosure. The acoustic generator according to the second embodiment illustrated in FIGS. 3 and 4 was manufactured and characteristics thereof were evaluated.

First of all, powder of a piezoelectric material containing lead zirconium titanate (PZT) obtained by substituting part of Zr with Sb, a binder, a dispersant, a plasticizer, and a solvent were kneaded through ball mill blending to produce slurry. Subsequently, through a doctor blade method, a green sheet was produced from the obtained slurry. A conductive paste containing Ag and Pd was applied to the green sheet by screen printing and a conductor pattern having a predetermined shape was thereby formed as an internal electrode layer. The green sheet on which the conductor pattern was formed and other green sheets were laminated one on top of another and were pressurized to produce a laminate molded body. The laminate molded body was degreased at 500° C. for one hour in the atmosphere; thereafter, the laminate molded body was sintered at 1100° C. for three hours in the atmosphere to obtain a laminate body.

Then, both end faces in the obtained longitudinal direction of the laminate body were cut by dicing to thereby expose a leading end of the internal electrode layer on a side surface of the laminate body. A conductive paste containing Ag and glass was applied by screen printing to the main surfaces on both sides of the laminate body to form surface electrode layers. The conductive paste containing Ag and glass was thereafter applied by dipping to both side surfaces in the longitudinal direction of the laminate body and was baked in the atmosphere at 700° C. for ten minutes to form terminal electrodes. The laminate body was thus produced. The produced laminate body had a width of 18 mm, a length of 46 mm, and a thickness of 0.1 mm. Polarization was subsequently performed by application of a voltage of 100 V through the terminal electrodes for two minutes to thereby obtain the exciter 1 as a bimorph laminated piezoelectric element.

Four types of resin films of polyimide, polyethylene terephthalate (PET), polyethylene naphthalate (PEN), and nylon were prepared for the vibrating body 3. Thickness was set to 0.025 mm. Stainless steel (SUS301H) having a thickness of 0.5 mm was used for each of the frames 6*a* and 6*b*. The frames 6*a* and 6*b* each have inside dimensions of 100 mm in length and 70 mm in width.

Subsequently, the peripheral edge portions of the vibrating body 3 to which tension was given were clamped and fixed by the frames 6*a* and 6*b* to which an adhesive was applied and were bonded with the frames with the adhesive being cured. The exciter 1 was bonded to one of the main surfaces of the vibrating body 3 using an adhesive and a conductive wire was joined to wire the exciter 1. The inside of the frame 6*a* was filled with an acrylic-based resin until the acrylic-based resin was flush with the frame 6*a*. The acrylic-based resin was then solidified to form the resin layer 20. The acoustic generator illustrated in FIGS. 3 and 4 was thus manufactured and the sound quality of the sound generated by the acoustic generator was evaluated.

Samples composed of the same materials as those used for the frames 6*a* and 6*b* and the four types of resin films mentioned above were manufactured for measuring the average coefficients of linear expansion and the average coefficients of linear expansion were measured. A TAS-200 manufactured by Rigaku was used as the measuring system. The temperature increase and decrease rates were 3° C./min., respectively. The samples had the following dimensions: SUS301H has a length of 10 mm, a width of 4 mm, and a thickness of 1 mm; and polyimide, PET, PEN, and nylon each has a length of 10 mm, a width of 4 mm, and a thickness of 0.025 mm. Measurements were taken under a condition with a compression load of 0.196 N being applied to SUS301H and a tensile load of 0.087 N being applied to polyimide, PET, PEN, and nylon. The ambience was air. Table 1 illustrates evaluation results of the sound quality and the average coefficients of linear expansion. In Table 1, the average coefficients of linear expansion are in units of $10^{-6}$/K.

TABLE 1

| | Frame | Vibrating body | | | |
|---|---|---|---|---|---|
| | SUS301H | Polyimide | PET | PEN | Nylon |
| Average coefficient of linear expansion (40° C. → 90° C.) | 17.1 | 12.7 | 22.2 | 2.4 | −1.5 |
| Average coefficient of linear expansion (90° C. → 40° C.) | 19.2 | 24.3 | 28.0 | 12.3 | 17.6 |
| Sound quality | — | ○ | ○ | X | X |

The measurements of the average coefficients of linear expansion revealed that, when SUS301H was used as the material for the frames 6*a* and 6*b*, use of polyimide or PET as the material for the vibrating body 3 satisfied the fourth condition that "the value of the average coefficient of linear expansion of the vibrating body 3 during the temperature change from 90° C. to 40° C. is not less than the value of the average coefficient of linear expansion of the vibrating body 3 during the temperature change from 40° C. to 90° C., and is not less than the value of the average coefficient of linear expansion of the frames 6*a* and 6*b* during the temperature change from 90° C. to 40° C.". The fourth condition was not satisfied when PEN or nylon was used as the material for the vibrating body 3.

The measurements of the average coefficients of linear expansion revealed that, when SUS301H was used as the material for the frames 6*a* and 6*b*, use of polyimide as the material for the vibrating body 3 satisfied the fifth condition that "the value of the average coefficient of linear expansion of the vibrating body 3 during the temperature change from 40° C. to 90° C. is not more than the value of the average coefficient of linear expansion of the frames 6*a* and 6*b* during the temperature change from 40° C. to 90° C.", in addition to the fourth condition. Neither the fourth condition nor the fifth condition were satisfied when PET, PEN, or nylon was used as the material for the vibrating body 3.

The measurements of the average coefficients of linear expansion revealed that, although not illustrated in Table 1, when SUS301H was used as the material for the frames 6*a* and 6*b*, use of PET as the material for the vibrating body 3 satisfied the sixth condition that "in a temperature change of every 10° C. from 90° C. to 40° C., the value of the average coefficient of linear expansion of the vibrating body 3 is not less than the value of the average coefficient of linear expansion of the frames 6*a* and 6*b*", in addition to the fourth condition. Neither the fourth condition nor the sixth condition were satisfied when polyimide, PEN, or nylon was used as the material for the vibrating body 3.

The evaluation results of the sound quality revealed that, when SUS301H was used as the material for the frames 6*a* and 6*b*, use of polyimide or PET as the material for the vibrating body 3 obtained sound having a sufficiently favorable sound quality. Use of PEN or nylon as the material for the vibrating body 3 failed to obtain sound having a favorable sound quality. When PEN or nylon was used as the material for the vibrating body 3, wrinkles were observed in the vibrating body 3.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The invention claimed is:

1. An acoustic generator, comprising:

a film-shaped vibrating body;

a frame configured to fix at least both ends of the vibrating body in a second direction perpendicular to a first direction that is a thickness direction of the vibrating body; and an exciter disposed on the vibrating body, and configured to vibrate itself to vibrate the vibrating body, wherein the vibrating body has a value of an average coefficient of linear expansion during a temperature change from 90° C. to 40° C. set to be not less than a value of the average coefficient of linear expansion of the vibrating body during a temperature change from 40° C. to 90° C., and set to be not less than a value of an average coefficient of linear expansion of the frame during a temperature change from 90° C. to 40° C., the frame fixes both the ends of the vibrating body in the second direction and both ends of the vibrating body in a third direction perpendicular to the first and second directions, and tension is given to the vibrating body in both the second and third directions, the tension in the second direction being different from that in the third direction.

2. The acoustic generator according to claim 1, wherein the vibrating body has a value of the average coefficient of linear expansion during a temperature change from 40° C. to 90° C. set to be not more than a value of the average coefficient of linear expansion of the frame during a temperature change from 40° C. to 90° C.

3. The acoustic generator according to claim 1, wherein, in a temperature change of every 10° C. from 90° C. to 40° C., the vibrating body has a value of the average coefficient of linear expansion set to be not less than a value of the average coefficient of linear expansion of the frame.

4. The acoustic generator according to claim 1, wherein the vibrating body is fixed to the frame in a condition of being given tension thereto.

5. An acoustic generating apparatus, comprising:

the acoustic generator according to claim 1; and an enclosure that surrounds at least part of at least one of main surface sides of the vibrating body.

6. An electronic apparatus, comprising:

the acoustic generator according to claim 1; and an electronic circuit connected to the acoustic generator, the electronic apparatus having a function of generating sound from the acoustic generator.

* * * * *